US010730660B2

(12) United States Patent
Herlin et al.

(10) Patent No.: US 10,730,660 B2
(45) Date of Patent: Aug. 4, 2020

(54) PAPERBOARD PACKAGING CONTAINER FOR BULK SOLIDS

(71) Applicant: Å&R Carton Lund Aktiebolag, Lund (SE)

(72) Inventors: Henrik Herlin, Kristianstad (SE); Simon Holka, Staffanstorp (SE); Eva Sunning, Lund (SE)

(73) Assignee: Å&R Carton Lund Aktiebolag (SE)

( * ) Notice: Subject to any disclaimer, the term of this patent is extended or adjusted under 35 U.S.C. 154(b) by 120 days.

(21) Appl. No.: 15/548,946

(22) PCT Filed: Feb. 2, 2016

(86) PCT No.: PCT/SE2016/050075
§ 371 (c)(1),
(2) Date: Aug. 4, 2017

(87) PCT Pub. No.: WO2016/126190
PCT Pub. Date: Aug. 11, 2016

(65) Prior Publication Data

US 2018/0016056 A1 Jan. 18, 2018

(30) Foreign Application Priority Data

Feb. 5, 2015 (SE) ..... 1550130

(51) Int. Cl.
*B65D 8/00* (2006.01)
*B65D 85/00* (2006.01)
(Continued)

(52) U.S. Cl.
CPC ..... *B65D 15/04* (2013.01); *B65D 5/0209* (2013.01); *B65D 15/06* (2013.01); *B65D 15/08* (2013.01);
(Continued)

(58) Field of Classification Search
CPC .... B65D 15/04; B65D 5/0209; B65D 5/1506; B65D 15/08; B65D 43/163; B65D 43/169;
(Continued)

(56) References Cited

U.S. PATENT DOCUMENTS 1,955,865 A 4/1934 Wellman
2,706,074 A 4/1955 La Grua et al.
(Continued)

FOREIGN PATENT DOCUMENTS

CH 453117 A 5/1968
CN 1914096 A 2/2007
(Continued)

OTHER PUBLICATIONS

Chinese Search Report for CN Application No. 2016800086014, dated Sep. 5, 2018.
(Continued)

*Primary Examiner* — Christopher R Demeree
(74) *Attorney, Agent, or Firm* — Lerner, David, Littenberg, Krumholz & Mentlik, LLP

(57) ABSTRACT

A paperboard packaging container for bulk solids includes a container body formed by a container wall having wall portions, and a container bottom. The wall portions are connected by corner portions and each wall portion extends in a height direction from a lower end edge at the container bottom to an upper end edge at a container opening, the height direction being perpendicular to a cross direction of the container. An upper reinforcing rim is applied to the container opening. Each of the upper and lower end edge of the container wall has end edge portions corresponding to the wall portions. At least one edge portion has an outwardly curved shape and a radius of curvature larger than a radius of curvature of each corner edge portion, the at least one end
(Continued)

edge portion bulges outwardly with a radius of curvature of 200-700 mm, preferably 300-600 mm, more preferably 400-500 mm.

19 Claims, 4 Drawing Sheets

(51) Int. Cl.

| | |
|---|---|
| ***B65D 77/30*** | (2006.01) |
| ***B65D 43/16*** | (2006.01) |
| ***B65D 51/20*** | (2006.01) |
| ***B65D 77/24*** | (2006.01) |
| ***B65D 5/02*** | (2006.01) |

(52) U.S. Cl.
CPC ..... *B65D 43/163* (2013.01); *B65D 43/169* (2013.01); *B65D 51/20* (2013.01); *B65D 77/245* (2013.01); *B65D 77/30* (2013.01); *B65D 85/70* (2013.01); *B65D 2251/009* (2013.01); *B65D 2251/0021* (2013.01); *B65D 2251/0028* (2013.01); *B65D 2251/0093* (2013.01); *B65D 2251/1025* (2013.01); *B65D 2543/00194* (2013.01); *B65D 2543/00435* (2013.01); *B65D 2543/00537* (2013.01)

(58) Field of Classification Search
CPC ..... B65D 51/20; B65D 77/245; B65D 77/33; B65D 85/70; B65D 2543/00092; B65B 7/28
USPC ..... 229/145, 125.08, 125.13; 53/471; 220/254.3, 203.05, 315, 810
See application file for complete search history.

(56) References Cited

U.S. PATENT DOCUMENTS

| | | | | |
|---|---|---|---|---|
| 3,042,288 | A | 7/1962 | Carpenter, Sr. | |
| 3,670,951 | A * | 6/1972 | Smith | B65D 43/0212 220/315 |
| 3,712,530 | A * | 1/1973 | Croley | B65D 15/06 229/4.5 |
| 4,883,193 | A * | 11/1989 | Christensson | B65D 15/22 220/266 |
| 4,917,289 | A * | 4/1990 | Linnemann | B65D 77/061 220/1.5 |
| 5,244,108 | A * | 9/1993 | Hale | B65D 19/06 206/596 |
| 5,743,422 | A * | 4/1998 | Hale | B65D 19/06 206/386 |
| 6,688,515 | B1 | 2/2004 | Huffman et al. | |
| 8,308,008 | B2 * | 11/2012 | Perry | B65D 43/169 206/508 |
| 8,627,981 | B2 * | 1/2014 | Perry | B65D 25/2897 206/553 |
| D781,700 | S | 3/2017 | Middleton et al. | |
| 9,637,287 | B2 | 5/2017 | Sagy et al. | |
| 9,834,341 | B2 | 12/2017 | Giraud et al. | |
| 9,834,347 | B2 | 12/2017 | Larsson et al. | |
| 2006/0156811 | A1 | 7/2006 | Borowski et al. | |
| 2007/0145001 | A1 | 6/2007 | Tilton | |
| 2008/0041861 | A1 | 2/2008 | Crawford et al. | |
| 2009/0230177 | A1 * | 9/2009 | Robertson | B65D 43/165 229/123.3 |
| 2011/0006066 | A1 | 1/2011 | Vandamme et al. | |
| 2011/0036868 | A1 | 2/2011 | Gotoh et al. | |
| 2011/0186570 | A1 | 8/2011 | Perry et al. | |
| 2011/0192847 | A1 | 8/2011 | Vandamme | |
| 2011/0266297 | A1 | 11/2011 | Thorpe et al. | |
| 2012/0061413 | A1 | 3/2012 | Dols et al. | |
| 2014/0131355 | A1 | 5/2014 | Jentis et al. | |

FOREIGN PATENT DOCUMENTS

| | | | |
|---|---|---|---|
| CN | 101372271 | A | 2/2009 |
| CN | 101848843 | A | 9/2010 |
| CN | 101870387 | A | 10/2010 |
| CN | 102712394 | A | 10/2012 |
| CN | 204021483 | U | 12/2014 |
| EP | 0006652 | A1 | 1/1980 |
| EP | 0312513 | A2 | 4/1989 |
| EP | 0442433 | A1 | 8/1991 |
| EP | 0781709 | A1 | 7/1997 |
| EP | 2527265 | A1 | 11/2012 |
| EP | 2716551 | A1 | 4/2014 |
| GB | 2096116 | A | 10/1982 |
| GB | 2261655 | A | 5/1993 |
| JP | H10329863 | A | 12/1998 |
| JP | 2009286403 | A | 12/2009 |
| WO | 2004048213 | A1 | 6/2004 |
| WO | 2014129887 | A1 | 8/2014 |

OTHER PUBLICATIONS

International Search Report for Application No. PCT/SE2016/050075 dated Jun. 7, 2016, 4 pages.
International Search Report for Application No. ITS/SE15/00025 dated Sep. 29, 2015, 5 pages.

* cited by examiner

PAPERBOARD PACKAGING CONTAINER FOR BULK SOLIDS

CROSS-REFERENCE TO RELATED APPLICATIONS

The present application is a national phase entry under 35 U.S.C. § 371 of International Application No. PCT/SE2016/050075 filed Feb. 2, 2016, published in English, which claims priority from Swedish Application No. 1550130-7 filed Feb. 5, 2015, all of which are incorporated by reference.

TECHNICAL FIELD

The invention pertains to a paperboard packaging container for bulk solids, the container comprising a container body formed by container walls including a front wall, a rear wall and two side walls and a container bottom, the container walls extending from the container bottom to a container opening in a height direction of the container, the height direction being perpendicular to a cross direction of the container and the container walls being connected by curved corner portions of the container body.

BACKGROUND

In the area of packaging of consumer goods, and in particular consumer goods which is packaged in relatively rigid packaging containers which serve as protective transport and storage containers at the retail end and as storage and dispensing containers at the consumer end, the different functions of the containers may result in conflicting demands on the packaging design. For economic and environmental reasons the amount of material required for producing the packaging containers should be as small as possible while still providing the packaging container with sufficient rigidity and shape stability. At the retail end there is a desire that the packaging containers allow efficient and space-saving transport and storage and preferably that they are stackable. However, when placed on a shelf in a shop, the packaging containers should preferably also have a display function and convey information to a prospective consumer about the contents in the package and its commercial origin. It may also be of importance to the manufacturer of the packaged goods and to the shop keeper that the packaging container has a distinctive design with high consumer appeal. The consumer may want a package that does not take up unnecessary space in a cupboard, on a shelf or on a counter-top but which has a design which makes the packaging container easily identifiable and appealing.

Hence, there is a continuing need for an improved packaging container for consumer gods in the form of bulk solids, which container to a higher degree than for previous containers meets the different and sometimes conflicting demands on such packaging containers during packaging, transport, storage, selling and use by a consumer.

SUMMARY

An object of the invention as disclosed herein, is to provide a packaging container for bulk solids which packaging container is better suited to meet the different demands on such packaging containers during manufacture, transport, storage, sale and use.

According to the invention, there is offered a paperboard packaging container for bulk solids. The packaging container comprises a container body formed by a container wall and a container bottom. The container wall extends in a height direction, H, of the container from a lower end edge at the container bottom to an upper end edge at a container opening, wherein the height direction, H, is perpendicular to a cross direction of the container. An upper reinforcing rim is applied to the upper end edge of the container wall. Each of the upper and lower end edge of the container wall comprises an edge portion corresponding to a wall portion, wherein the edge portion has an outwardly curved shape with a radius of curvature of 200-700 mm, preferably 300-600 mm, more preferably 400-500 mm.

The container wall may comprise at least two wall portions with corresponding wall end edge portions. The wall portions may comprise a front wall portion, a rear wall portion and two side wall portions and each of the upper and lower end edge of the container wall may comprise a front end edge portion, a rear end edge portion and two side end edge portions corresponding to the wall portions.

At least one wall portion may be connected to another wall portion by a curved corner portion forming part of the container wall. The radius of curvature of the corner portion or corner portions is smaller than the radius of curvature of the wall portions which are connected by the curved corner portion portions.

A curved corner portion may have a radius of curvature of 5-60 mm, preferably 10-40 mm, more preferably 15-30 mm.

The container wall may comprise two wall end edge portions and two corresponding wall portions having an outwardly curved shape and having a radius of curvature of 200-700 mm, preferably 300-600 mm, more preferably 400-500 mm.

The two wall end edge portions and the two corresponding wall portions may be opposing wall end edge portions and wall portions, such as opposing front and rear wall portions or opposing side wall portions.

The two wall end edge portions and the two corresponding wall portions may be outwardly bulging with the same radii of curvature.

The packaging container may be a container having a four-sided foot-print and comprising a front wall portion, a rear wall portion and two side wall portions and a container bottom, the container wall portions being connected by curved corner portions of the container body. The upper reinforcing rim comprises a corresponding front rim portion, a rear rim portion and two side rim portions which are connected by corner rim portions. Each upper and lower end edge of the container wall has a front edge portion, a rear edge portion, two side edge portions and corner edge portions corresponding to the front wall portion, the rear wall portion, the side wall portions and the corner portions of the container body. At least two opposing edge portions of the front edge portion, the rear edge portion and the side edge portions may have an outwardly curved shape with a radius of curvature which is larger than the radius of curvature of each of the corner edge portions. At least one of the outwardly curved wall portions is outwardly bulging with a radius of curvature of 200-700 mm, preferably 300-600 mm, more preferably 400-500 mm.

As a consequence of one or more portion of the upper wall end edges of the upper and lower end edges of the container walls being outwardly curved by being conformed to an outwardly curved portion of the upper reinforcing rim, the corresponding container wall has an outwardly bulging shape with a stable and controlled outwardly convex curvature.

The packaging container walls may be provided with any desired shape by bringing the body wall edge to conform to the rigid upper reinforcing rim having the desired footprint shape with the selected outward curvature of at least one curved wall portion. The container body shape can optionally be further stabilised by means of a rigid bottom rim having the desired footprint shape and being attached to the container body at the container bottom edge.

The provision of at least an upper reinforcing rim, ascertains that the curved wall portions retain the selected outward curvature and prevents the wall portions from bulging inwards. Inwardly bulging wall portions is a phenomenon known to occur in paperboard packaging containers and presents a problem in that it may negatively affect the stability of the packaging container and in that it detracts from a perceived quality and appearance of the packaging containers.

In paperboard containers, there is a conflict between minimizing the amount of paperboard material used in the containers and making the containers sufficiently rigid to avoid that the containers are damaged or that they collapse, e.g. when stacked during transport and storage. It has been found that by making one or more container walls only slightly outwardly curved, shape stability and rigidity of the packaging container may be considerably improved as compared to conventional packaging containers having planar walls. Consequently, paperboard packaging containers having adequate rigidity and crush-resistance may be made using thinner paperboard sheets than in a paperboard packaging container having planar side walls.

The radii of curvature of the upper and lower end edges which govern the curvature of the container walls may be selected such that the container walls are provided with a near-planar shape, implying that the container walls are perceived by a consumer as being planar. Further, it has been found that even by providing the container walls with a very slight outwardly directed curvature, such that the container walls are near-planar, stackability of the packaging container may be improved as the crush resistance in the height direction of the container is increased. A slight outward curvature which deviates minimally from a planar shape also provides the packaging container with a three-dimensional shape allowing space efficient transport and storage. A container wall portion or container wall edge portion having a radius of curvature of 200-700 mm, preferably 300-600 mm, more preferably 400-500 mm has been found to be perceived as being near-planar or near-linear, respectively.

As used herein, a paperboard packaging container is a packaging container wherein at least the container body is formed from paperboard web material. The web material may be provided in the form of a continuous web or may be provided as individual sheets of material. The paperboard container may be formed in any manner known in the art, e.g. by forming a container body by bending a paperboard material into a tubular shape and longitudinally closing the tube by joining overlapping or abutting side edges of the paperboard material. The joint between the side edges may be covered by a sealing strip. Joining of the material edges may be made by any suitable method such as by adhesive or welding, with welding generally being preferred. The container bottom may be formed from a separate bottom disc which is attached by welding or by means of adhesive at one end of the container body tube or which may be formed by folding an end portion of the container body tube.

As used herein, a paperboard material is a web material predominantly made from cellulose fibers or paper fibers. The paperboard material may be a single ply or multi ply material and may be a laminate comprising one or more layers of other materials such as polymeric materials, metal foil, etc. The paperboard material may be coated, printed, embossed, etc. and may comprise fillers, pigments, binders and other additives as known in the art. The paperboard materials as disclosed herein may also be referred to as cardboard or carton materials.

The container bottom may be made from paperboard, plastic, metal, etc., as known in the art. The lid may, for instance, be made from plastic or metal or may be made from paperboard or from a paperboard/plastic laminate. Plastic lids may be preferred as they can be made rigid, durable and water resistant, and as they can be produced in any desirable shape by well-known production methods such as injection molding.

The packaging container as disclosed herein may comprise an inner peelable or openable sealing membrane forming a cross-sectional seal between an interior compartment in the container body and the container opening. The paperboard packaging container may be a gas-tight container and the inner peelable or openable sealing membrane may be a gas-tight peelable or openable sealing membrane.

An openable and closable container lid may be arranged to engage with the upper edge rim to form a closure on the container. The closure between the container lid and the upper edge rim is preferably a sift-proof closure, more preferably a moisture-proof closure and most preferably a gas-tight closure.

A tight closure between the container lid and the upper edge rim may be accomplished by mating contours on the lid and on the rim and may include snap-lock or press-in features such as interengaging ridges and tracks or protrusions and holes/cavities, etc.

The packaging containers as disclosed herein are containers for bulk solids, which are flowable pulverulent materials capable of being poured or scooped out of the containers. The containers are generally disposable containers, which are discarded when they have been emptied of their contents. A concern in packaging containers for pulverulent bulk solids is that the containers are sufficiently tight or at least "sift-proof" to prevent the pulverulent material from escaping out of the container for example between the container lid and the edge rim.

The barrier properties of the packaging containers disclosed herein, may be designed to meet different requirements of tightness depending on the goods which is packaged in the packaging container. By way of example, in a packaging container for dried peas a lower barrier level may be sufficient than in a packaging container for e.g. infant formula which is highly sensitive to oxygen and moisture exposure. A combination of a gas-tight gasketing seal between the upper edge of the upper reinforcing rim and the inner surface of the container lid, and a gas-tight weld seal between the upper reinforcing rim and the inner surface of the container wall may offer a packaging container with excellent barrier properties also after the sealing membrane has been removed.

The packaging containers as disclosed herein may have barrier properties which remain largely unaltered even after removal of the inner sealing membrane. In other words, the contents in a closed packaging container may be equally well protected or nearly equally well protected regardless of whether the inner sealing membrane has been removed or not. This also means that also temporary seals such as a seal created by between the lid and an upper reinforcing rim and permanent seals such as a weld seal between the upper reinforcing rim and the inner wall of the packaging container preferably have barrier properties offering the same level of protection of the packaged contents as the inner sealing membrane and other container components which separate the contents in the container from the environment outside the packaging container.

A packaging container having a volume of approximately 11 may be considered to be gas-tight if it provides an oxygen barrier of approximately 0.006 cc oxygen/24 h or less at 23° C. and 50% relative humidity.

The closure between the container lid and the container body may comprise or be provided by a locking arrangement comprising a first locking element arranged on the container body or on an edge rim and a second locking element arranged on the container lid. The first and second locking elements are mating locking elements, such as female/male locking elements including hooks and other protrusions which are arranged to interengage with ridges, hooks, tracks, holes, cavities, loops, etc. By way of example, a locking arrangement may be provided by a locking flap or clasp closure extending from the forward edge on the lid and comprising at least one locking element which can be fastened into or onto a corresponding locking element on the container body or on an edge rim attached at the container opening. The locking elements are preferably designed to allow repeated opening and closing of the locking arrangement. Manipulation of the locking arrangement may be facilitated by means of gripping devices such as finger grips, friction enhancing elements, etc.

The container lid may be provided as a separate component which can be completely removed when opening the container. Alternatively, the container lid may be attached to the container body or to the edge rim by means of a hinge. The hinge may be a live hinge, i.e. a bendable connection between the lid and the container body or upper plastic rim. A live hinge may be formed integral with the lid and/or with a plastic or metal edge rim or an upper edge portion of a container body or may be a separately formed element which is attached to the container lid and to the container body or an edge rim. Alternatively, the hinge may be a two-part hinge, with a first hinge part arranged on the container lid and a second hinge part arranged on the container body or on an edge rim.

The packaging container as disclosed herein may comprise mating stacking members for allowing two or more of the packaging containers to be arranged in a stacked configuration. The mating stacking members are arranged at the container bottom and at the container opening. A stacking member or stacking members at the container opening may be arranged on the container lid and/or on an edge rim surrounding the opening in the packaging container. The container lids may be provided with mating stacking members arranged on the upper outer surface and on the inner lower surface of each lid, making the lids separately stackable before being applied to a packaging container, e.g. in a process for producing the packaging containers as disclosed herein.

The corner portions of the packaging container may be curved corner portions having a radius of curvature of 5-60 mm, preferably 10-40 mm, more preferably 15-30 mm.

As set out herein, at least one of the container wall portions has a radius of curvature of from 200 millimeter to 700 millimeter, preferably from 300 to 600 mm, more preferably from 400 to 500 mm implying that the container wall portion is near-planar. A near-planar wall portion as defined herein is a wall portion which is perceived by a human being as being planar when viewed from a normal viewing distance, such as when placed on a shelf. A four-sided packaging container having all body wall portions being near-planar is generally perceived as having a cuboid shape, i.e. the human eye will see the container body as having square or rectangular side walls and bottom.

As used herein, the term "cuboid" refers to a polyhedron having rectangular or generally rectangular faces. A cuboid packaging container may have rounded or bevelled edges. Although individual structures of a cuboid packaging such as a lid, a rim, corner portions, locking members, etc. may cause the shape of the packaging container to deviate from a perfect rectangular cuboid, the overall impression of the container shape is that of a rectangular cuboid.

As the deviation from a perfect cubic or rectangular shape may be negligible in a packaging container as disclosed herein, such containers are excellent for transportation and storing purposes as they allow for space-efficient and stable stacking.

Opposing container side wall portions may be outwardly bulging with the same radii of curvature. Likewise, opposing front wall and rear wall portions may be outwardly bulging with the same radii of curvature. Furthermore, all container body wall portions may be outwardly bulging with the same radius of curvature.

A front wall portion may be outwardly bulging with a smaller radius of curvature than a rear wall portion and may be outwardly curved with a radius of curvature of 70 mm-150 mm such that the container body has a generally D-shaped cross-section. A D-shaped cross-section with an outwardly curved front wall portion provides the packaging container with an enlarged surface for displaying visually detectable graphics, and other visually identifiable structures at the front of the container, such as brand names, illustrations or instructions. Moreover, a container body having a generally D-shaped cross-section is space-saving, since it may be positioned close up to e.g. a kitchen wall or a cupboard wall.

As set out herein, the paperboard container may be a gastight paperboard container and may comprise an inner peelable or openable sealing membrane forming a cross-sectional seal between an inner compartment in the container body and the container opening. By an openable or peelable sealing membrane is meant a membrane that may be fully or partly removed by a user in order to provide access to an interior compartment of the packaging container either by breaking a seal between the sealing membrane and the inner surface of the container wall, or by tearing or otherwise breaking the sealing membrane itself.

A peelable or tearable sealing membrane may be gastight or gas-permeable. A gastight membrane may be manufactured from any material or material combination suitable for providing a gastight sealing of a compartment delimited by the sealing membrane, such as aluminium foil, silicon-coated paper, plastic film, or laminates thereof. A gastight membrane is advantageous when the bulk solids stored in the packaging container are sensitive to air and/or moisture, and it is desirable to avoid contact of the packaged bulk solids with ambient air.

The packaging container as disclosed herein may comprise a lower plastic rim which is applied to an end edge of the container body which is located at the container bottom. A lower plastic rim may be used to provide the container body with a selected three-dimensional shape and may increase shape stability of the packaging container. Moreover, as a lower plastic rim is water and moisture resistant it may protect a paperboard packaging container and, in particular, a paperboard bottom wall of the packaging container from moisture on a surface on which the packaging container has been placed.

The packaging container as disclosed herein may be a container for "bulk solids", i.e. pulverulent or granulated consumer goods, including alimentary or consumable products such as formula, tea, coffee, cocoa, sugar, flour, tobacco, etc., as well as house-hold chemicals such as detergents and dishwasher powder. The pulverulent or granulated products which are suitable for packaging in the packaging containers as disclosed herein are flowable, which means that a desired amount of the product may be poured or scooped out of the packaging container.

By a pulverulent material as used herein is implied any material in the form of particles, granules, grinds, plant fragments, seeds, etc.

As mentioned above, the container body of the packaging container as disclosed herein may have two or more main body wall portions, such as three main body wall portions, four main body wall portions, etc. In the case of the packaging container having four main body wall portions, it may have a front wall portion arranged opposite a rear wall portion and two opposing side wall portions extending between the front wall portion and the rear wall portion. The body wall portions are connected at the curved corner portions. As set out herein, the curvature of any of the body wall portions is always lesser than the curvature of any corner portion, i.e. a radius of curvature of a corner portion in the container body of the packaging container as disclosed herein is always smaller than any radius of curvature of a body wall portion. A transition between a corner portion and a body wall portion may be seen as a distinct change in curvature or may be seen as a continuous change in curvature.

A rigid plastic upper reinforcing rim as disclosed herein which is attached along the opening edge of the container body mechanically and/or by gluing or welding contributes to shaping and stabilizing of the container body opening edge and also ascertains that the container body wall is provided with a desired shape and in particular that the container body wall can be imparted with a predetermined and stable curvature. In a corresponding manner, when the packaging container as disclosed herein is provided with a reinforcing bottom rim, the bottom rim further contributes to shaping and stabilizing of the container body bottom edge.

BRIEF DESCRIPTION OF THE DRAWINGS

The present invention will be further explained hereinafter by means of non-limiting examples and with reference to the appended drawings wherein.

DETAILED DESCRIPTION

It is to be understood that the drawings are schematic and that individual components, such as layers of material are not necessarily drawn to scale. The cuboid packaging container and the container bodies shown in the figures are provided as examples only and should not be considered limiting to the invention. Accordingly, the scope of the invention is determined solely by the appended claims.

Figure 1:
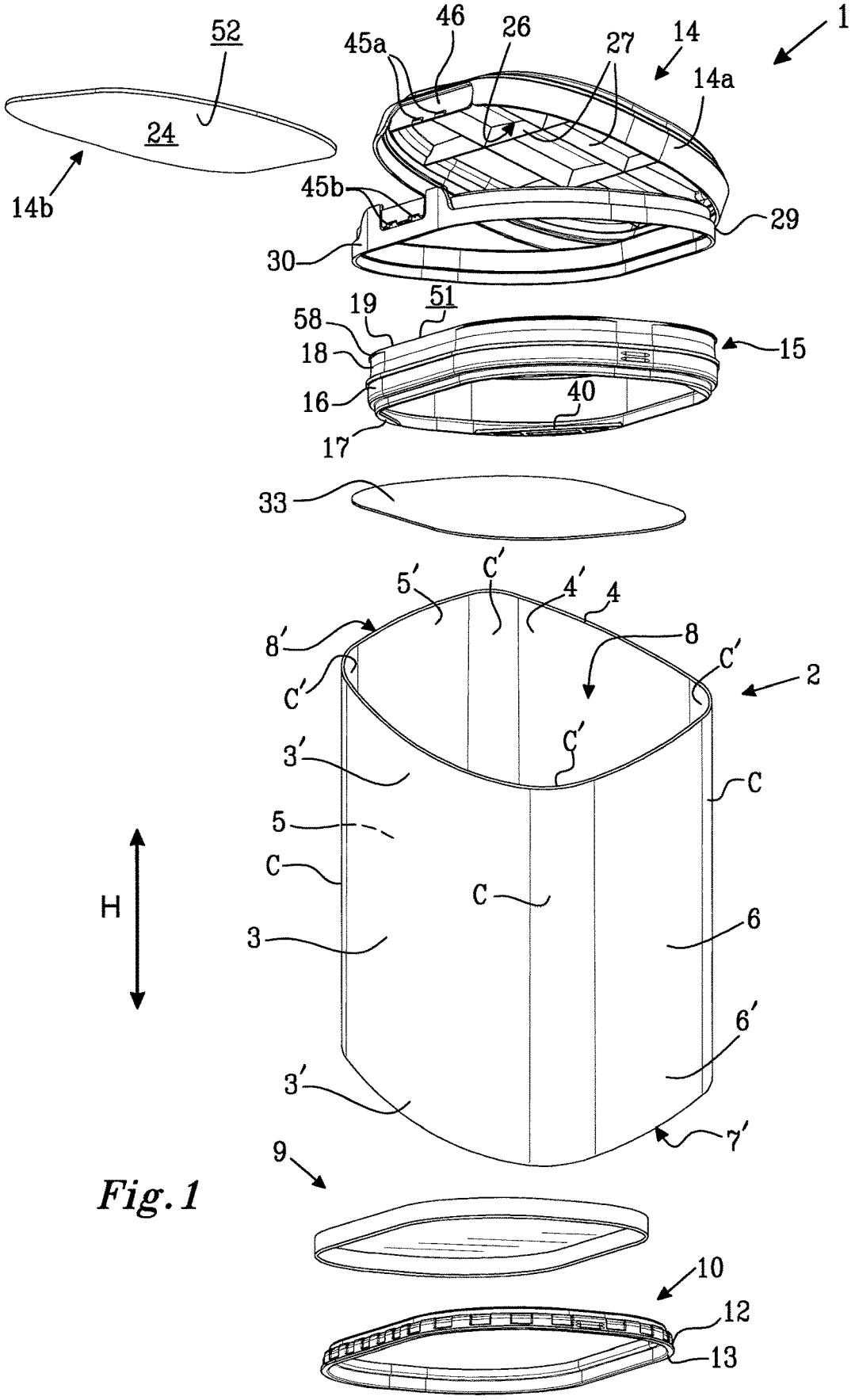
FIG. 1 shows an exploded view of a packaging container according to the invention.
Figure 2:
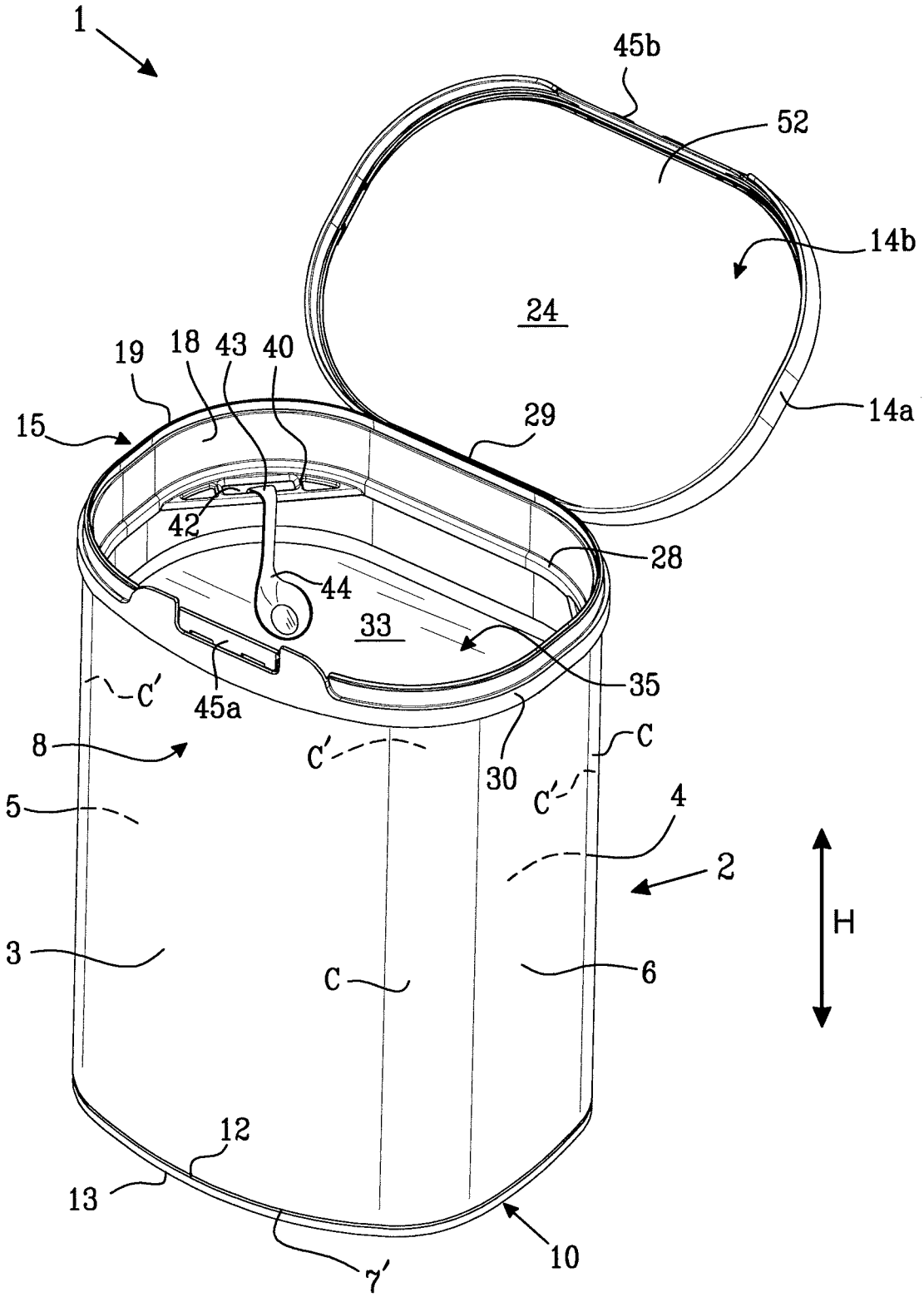
FIG. 2 shows the packaging container in FIG. 1 in an assembled state and with the lid in an open configuration.

With reference to FIGS. 1 and 2 there is shown a paperboard packaging container 1 for pourable or scoopable bulk solids.

A height direction H of a packaging container as disclosed herein is the vertical direction of the packaging container when standing with its bottom placed on a horizontal surface. Accordingly, the height direction H is perpendicular to the horizontal direction.

The packaging container 1 comprises a container body 2 formed by a tubular container wall 3 including a front wall portion 3, a rear wall portion 4 and two side wall portions 5, 6. The container wall portions 3, 4, 5, 6 extend from a container bottom 7 to a container opening 8 in a height direction H of the packaging container 1. The container walls 3, 4, 5, 6 have an inner surface facing towards an inner compartment 11 in the packaging container 1 and an outer surface facing away from the inner compartment 11 and being exposed to the exterior of the packaging container 1. A bottom disc 9 is positioned at the bottom edge 7' of the container body 2. The container body 2 is made from paperboard material as defined herein. As disclosed herein, the container body 2 may be formed by bringing together the side edges of a web of paperboard causing the material to assume a tubular shape, where after the side edges are sealed together. Sealing of the side edges may be made by any suitable method as known in the art, such as by welding or gluing, with welding being preferred. Sealing of the side edges of the container body web may involve using a sealing strip, as known in the art. The bottom disc 9 may be made from paperboard, metal, plastic, or from any suitable combination of such materials as known in the art.

Figure 1A:
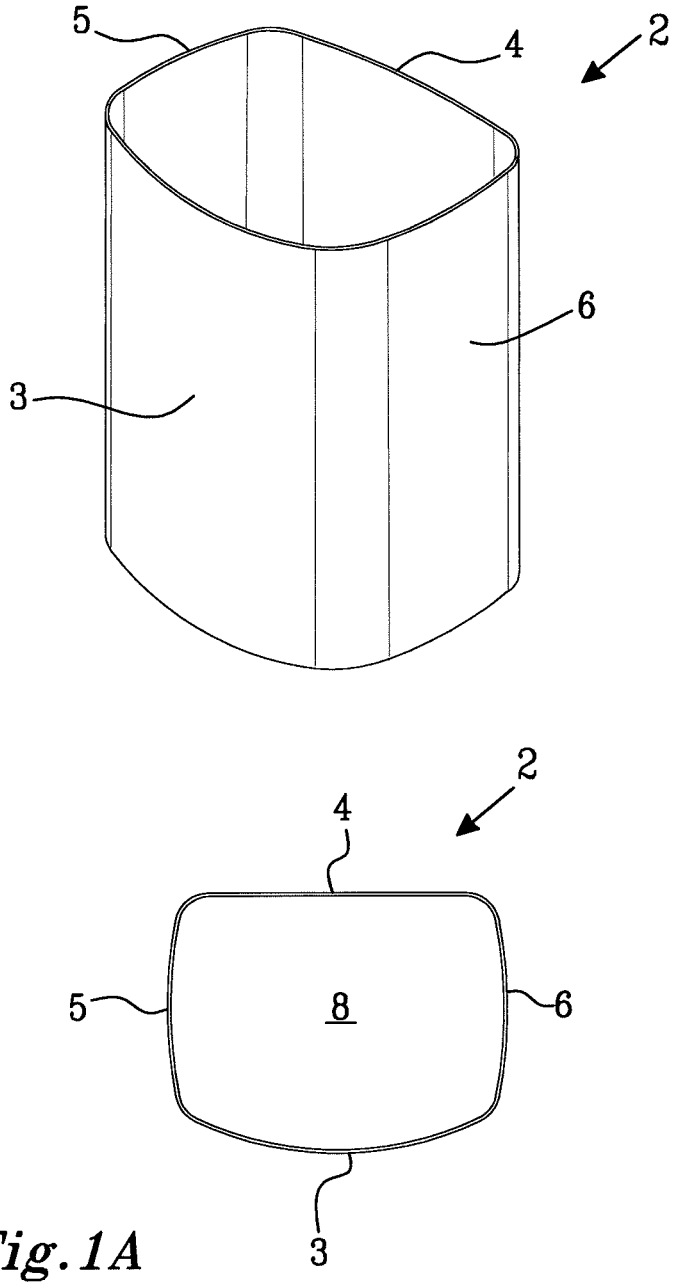
FIG. 1A shows the container body of the packaging container in FIG. 1.

The front wall portion 3 is curved with a radius of curvature of 120 mm, while the rear wall portion 4 is curved with a radius of curvature of 400 mm. The side wall portions 5 and 6 are shown to be planar. The corner portions adjacent to the front wall portion 3 have a radius of curvature of 25 mm, while the other two corner portions have a radius of curvature of 20 mm. Other curvatures of the wall portions and the corner portions may be selected as set out herein. As may be seen in FIGS. 1, 1A and 2, the container body 2, thus, has a generally D-shaped cross-section. As set out herein, a packaging container having a container body with a D-shaped cross-section provide advantages both with regard to the stability and crush resistance of the packaging container and with regard to the display function.

The bottom edge 7' of the container body is reinforced by a plastic bottom rim 10 which is applied to the inner surface of the container body 2, between the bottom disc 9 and the container body bottom edge 7' and which has an outwardly directed flange 12 which covers the container body bottom edge 7' and forms a bottom edge 13 of the packaging container 1. The bottom rim 10 reinforces the container body paperboard bottom edge 7', stabilizes the shape of the container body 2 and protects the container body bottom edge 7' from mechanical deformation. The plastic bottom rim 10 also serves as a protective barrier against water and other fluids which may be present on a surface on which the packaging container is placed. The bottom rim 10 delimits a downwardly open space between the bottom disc 9 and the bottom edge 13 of the packaging container 1 which may be used to accommodate stacking elements arranged at an upper end of another packaging container when stacking two or more packaging containers on top of each other. Further, the bottom rim 10 ensures that the wall portions 3, 4, 5, and 6 are curved in a desired and controlled manner, such that the optimal radius of curvature is maintained even if the container body is subjected to impacts or other forces that may occur during normal handling of the container, i.e. if the container is dropped or squeezed during shipping or use.

As an alternative to a plastic bottom rim 10, the bottom edge 7' of the packaging container may be formed by a rolled edge of the paperboard container body, or may be provided with a simple, non-rolled join between the bottom disc 9 and the container body 2.

The paperboard packaging container 1 depicted in FIGS. 1 and 2 is provided with a closure arrangement comprising a lid 14 and an upper reinforcing rim 15 extending along the container body opening edge 8' and defining a perimeter of a container access opening which is smaller than the container body opening 8 which is defined by the upper edge 8' of the container body 2.

The upper reinforcing rim 15 is preferably a plastic rim, most preferably a thermoplastic rim and is attached to the inner surface of the container body wall at the container body opening 8. The upper reinforcing rim 15 has an extension in the height direction, H, of the container 1 and has a lower rim part 16 with a lower rim edge 17 facing towards the container bottom 7 and an upper rim part 18 with an upper rim edge 19 facing away from the container bottom 7. The upper reinforcing rim 15 extends around the full periphery of the container body opening 8. The upper rim part 18 protrudes upwards in the height direction, H, above the container body opening edge 5, whereby the upper edge 19 of the upper reinforcing rim 15 is arranged above the container body opening edge 8' in the height direction, H, of the packaging container 1. Analogous to the function of the bottom rim 10, the upper reinforcing rim 15 ensures that the wall portions 3, 4, 5, and 6 are curved in a desired and controlled manner, such that the optimal radius of curvature is maintained even if the container body is subjected to impacts or other forces that may occur during a normal handling, i.e. if the container is dropped, squeezed or otherwise deformed during shipping or use.

The lid 14 is formed from an outer lid part 14*a* and an inner lid part 14*b*. The outer lid part 14*a* is a profiled part with a three-dimensional shape providing an upper outer surface 25 of the lid 14. As is shown in FIG. 1, the outer lid part 14*a* has an inner surface 26 comprising a pattern of reinforcing ribs 27. The inner lid part 14*b* is a planar disk. The inner lid part 14*b* has an inner lid surface 24 which faces towards the bottom disc 9 when the lid 14 is closed on the container access opening 35.

The outer lid part 14*a* is connected by a hinge 29 to a frame structure 30, the lid 14 and the frame structure 30 together forming a lid component 31. The hinge 29 is a live hinge, formed integrally with the upper lid part 14*a* and the frame structure 30 as a flexible connection between the upper lid part 14*a* and the frame structure 30. As set out herein, the illustrated hinge is only intended as a non-limiting example and it should be understood that any other type of functional hinge may be used for the connection between the frame structure and the lid. Moreover, the lid may be of the removable kind, without any permanent connection to the frame structure.

The frame structure 30 is applied to the packaging container at the container body opening edge 8' and is mechanically attached to the upper reinforcing rim 15 by a snap-on connection. The frame structure 30 is attached to the upper reinforcing rim 15 after the reinforcing rim 15 has been welded to the inner surface 7 of the paperboard container wall 3. The frame structure 30 is applied to the upper reinforcing rim 15 by pressing the frame structure 30 down over the upper edge 19 of the upper reinforcing rim 15 until the frame structure 30 locks in place on the upper reinforcing rim 15 by means of mating snap-in features on the upper reinforcing rim 15 and the frame structure 30. When the frame structure 30 has been attached to the upper reinforcing rim 15, it can only be removed again by breaking or damaging the snap-in connection between the rim 15 and the frame structure 30.

It is to be understood that the two-part rim and frame structure construction shown in FIGS. 1 and 2 are optional to the invention, and that the packaging container may instead be provided with a simple one-part upper rim, as known in the art. A one-part rim may be directly connected with a lid by means of an integrated hinge or a two-part hinge or may be arranged to cooperate with a completely removable lid to close the container.

The interior compartment 11 is sealed with a fully or partly removable sealing membrane 33 which is applied over the packaged goods 34 and which is sealed to the container body wall 3. The removable sealing membrane 33 may be attached to the container wall either from the top end of the container body 2 or from the bottom end of the container body 2. In order to gain a first access to the packaged goods, a user needs to open the lid 14 and expose the packaged goods 34 by fully or partly removing the sealing membrane 33. The sealing membrane 33 may be arranged to be peeled away from the wall 3 of the container body 2 or may be arranged with means for breaking the membrane 33 so that it can be at least partly removed from the opening 8. Such means may be in the form of one or more predefined weakenings, such as perforations or a cut partly through the membrane. When the membrane is of the tear-open type, a narrow edge part of the sealing membrane may be left at the inner surface 7 of the container wall 3. Any such remaining part of the sealing membrane should preferably not be so large so that it extends into the access opening which is defined by the inner perimeter of the upper reinforcing rim. Accordingly, it may be preferred that a remaining membrane part has an extension perpendicular to the height direction H of the packaging container of at most 7 millimeters such as 1-6 millimeters, 2-5 millimeters or 3-4 millimeters. It may be preferred that the inward extension of a remaining membrane part is 4 millimeters or less. The sealing membrane 33 is an optional feature of the disclosed packaging container 1 and may be omitted.

Once the sealing membrane 33 has been removed, it is sufficient to open the lid 14 in order to gain access to the packaged goods 34 in the interior compartment 11 through the access opening 35. As is seen in FIG. 2, which reveals the inside of the upper reinforcing rim 15, the area of the access opening 35 is defined by an inner perimeter 28 or inner contour of the upper reinforcing rim 15. As the upper reinforcing rim 15 is applied on the inner surface 7 of the container body wall 3 and adds thickness to the body wall in an inward direction, the area of the access opening 35 is always smaller than the area of the container body opening 6. The upper reinforcing rim 15 which is shown in FIG. 2 has a combined scraper bar and scoop holder 40 which extends across a corner portion of the reinforcing rim 15. The combined scraper bar and scoop holder 40 is provided with a scraping edge 41 for scraping off excess scooped-up contents from a scoop or spoon 44 and an opening 42 constituting a first scoop fastening element for receiving and holding a second scoop fastening element in the form of a hook element 43 on the spoon 44.

When the packaging container 1 is open, a desired quantity of the packaged goods 34 may be removed from the packaging container 1 through the access opening 35 by means of the scoop 44. The scoop may preferably be provided together with the packaging container 1. The scoop 44 may initially be placed on the sealing membrane 33, if present, may be removably attached to the inner lid surface 26 or may be attached to the combined scraper bar and scoop holder 40.

The second scoop fastening element 43 on the scoop 44 is arranged to cooperate with the first scoop fastening element 42 on the combined scraper bar and scoop holder 40, whereby the scoop 44 may be attached to the reinforcing rim 15 such that the handle 50 on the scoop 44 is prevented from falling down into the contents in the packaging container compartment 11 between dispensing occasions. Users find it more appealing and hygienic to be able to remove the scoop from the container without having to dig it out from the remaining contents in the packaging container. A further advantage with combining the holding function with a scraper function, is that the combined scraper bar and scoop holder 40 intrudes minimally on the open area of the access opening 35. Accordingly, even if provided with the combined scraper bar and scoop holder 40 as disclosed herein, the packaging container has a large access opening with an opening edge without any portion of the edge being curved or inwardly in the plane of the access opening or having any edge portion forming an inwardly directed protrusion from the container body edge. A regularly shaped access opening edge without any protruding features that may obstruct the access opening greatly facilitates removal of the contents from the packaging container by scooping and also by pouring.

The access opening 35 may have an opening area which is from 85% to 99% of the opening area of the container body opening 8, such as from 90% to 98% of the container body opening area or from 94% to 97% of the container body opening area.

A tight closure between the lid 14 and the container body 2 is provided by a first abutment surface 51 on the upper rim edge 19 and a corresponding second abutment surface 52 arranged on the inner lid surface 24. The first abutment surface 51 on the upper reinforcing rim 15 is arranged to abut against the second abutment surface 52 on the lid 14 when the lid is in the closed position on the container access opening 35 and to form a seal between the upper reinforcing rim 15 and the lid 14.

In order to keep the lid 14 secured in the closed position between dispensing occasions, the closure arrangement of the packaging container 1 may further comprise a locking arrangement 45. The locking arrangement 45 may comprise mating locking elements 45*a*, 45*b*. A male locking element 45*a* is arranged on the lid 14 and a female locking element 45*b* is arranged on the frame structure 30. The male locking element 45*a* is constituted by one or more protrusions, such as one or more knobs or ribs arranged on a locking flap 46 and the female locking element 45*b* is constituted by one or more corresponding cavities or grooves arranged on the frame structure 30. The locking arrangement 45 is preferably designed such that it exerts a force on the connection between the lid 2 and the upper rim edge 19 by pressing the first and second abutment surfaces 51, 52 together.

Figure 3:
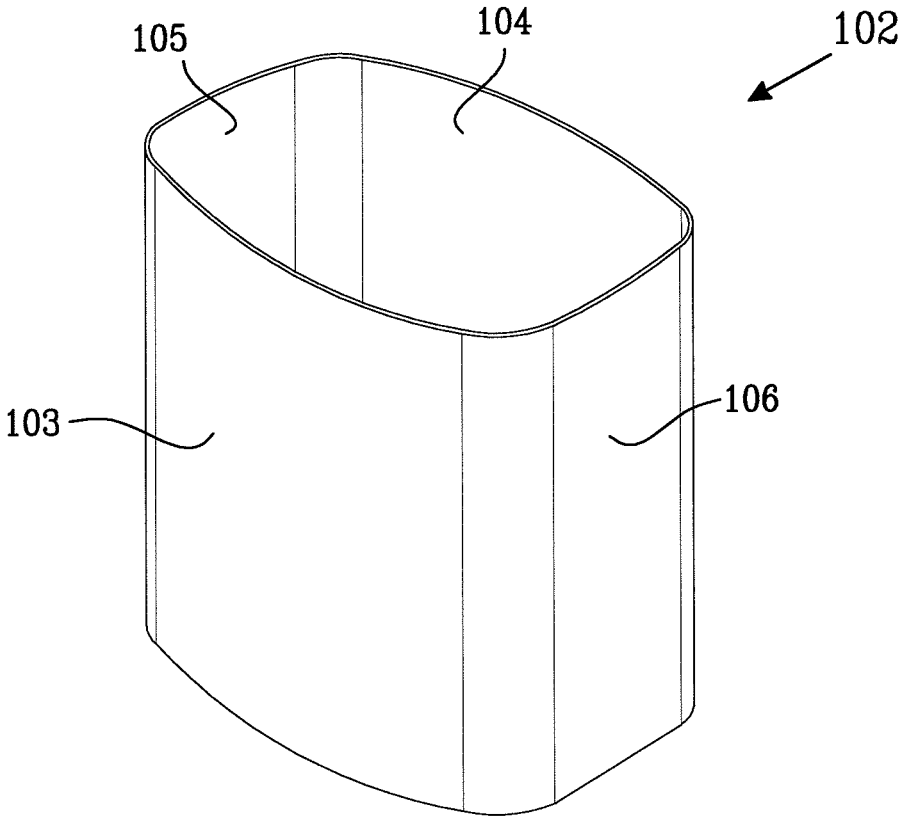
FIG. 3 shows an alternative embodiment of a container body.
Figure 3:
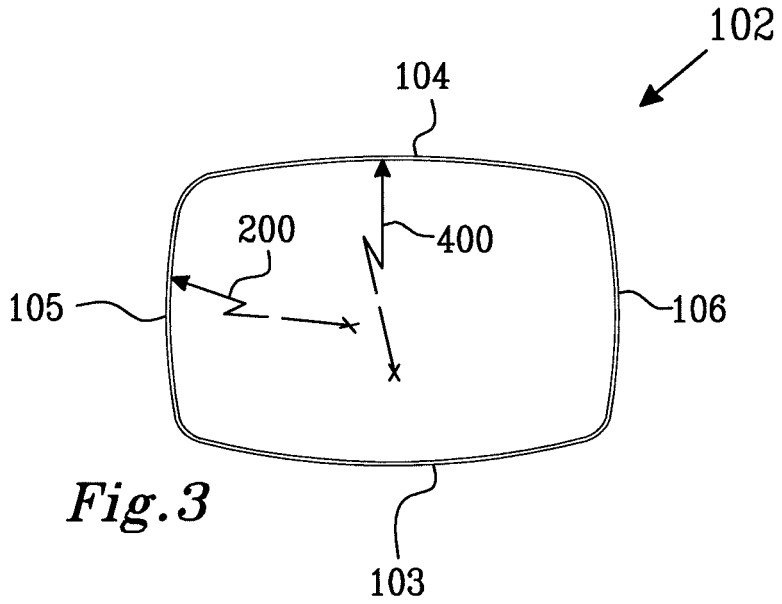

FIG. 3 illustrates an alternative shape of the container body 102. The front wall portion 103 and the rear wall portion 104 of the container body 102 depicted in FIG. 3 have a radius of curvature of 400 mm. As may be seen in FIG. 3, the front wall portion 103 and the rear wall portion 104 have a relatively large radius of curvature and are "near planar" as defined herein. These wall portions are perceived as being planar by an unaided human eye. The side wall portions 105 and 106 of the container body 102 are also curved, having a radius of curvature of 200 mm, i.e. the side wall portions 105 and 106 are slightly more outwardly bulging compared to the front wall portion 103 and the rear wall portion 104 but are still perceived as being planar by an unaided human eye. As mentioned above, the radius of curvature of the wall portions of the container body according to the present invention is a compromise between stability and pack efficiency of the packaging containers. While it is advantageous to provide the wall portion of the container body with a slight curvature in order to provide the wall portions with additional stability and crush resistance, a too small radius of curvature may impair space efficiency of the packaging containers when the packaging containers are shipped or stored.

A container body shape as shown in FIG. 3 offers a cuboid packaging container having high stability and crush resistance as well as space efficient transport and storage properties.

The invention claimed is:

1. A paperboard packaging container for bulk solids, said container comprising:

a container body formed by a container wall and a container bottom, said container wall extending in a height direction of said container and having a maximum height from a lower end edge at said container bottom to a terminal upper end edge at a container opening, said height direction being perpendicular to a cross direction of said container, an upper reinforcing rim being applied to said upper end edge of said container wall;

a bottom disc positioned at the lower end edge of the container body; and a bottom rim applied to an inner surface of the container body and positioned between the bottom disc and the lower end edge, the bottom rim configured to reinforce the lower end edge of the container body and to delimit a downwardly open space between the bottom disc and a bottom edge of the packaging container, wherein each of said upper and lower end edge of said container wall includes an edge portion corresponding to a wall portion, said edge portion of said container wall and said corresponding wall portion having an outwardly curved shape and having a radius of curvature of 300-600 mm.

2. The paperboard packaging container according to claim 1, wherein said container wall includes at least two wall portions.

3. The paperboard packaging container according to claim 2, wherein said container wall includes a front wall portion, a rear wall portion and two side wall portions and each of said upper and lower end edge of said container wall includes a front end edge portion, a rear end edge portion, two side end edge portions corresponding to said wall portions.

4. The paperboard packaging container according to claim 3, wherein said front wall portion has a radius of curvature of 70-150 mm, said container body having a generally D-shaped cross-section.

5. The paperboard packaging container according to claim 1, wherein at least one said wall portion is connected to another wall portion by a curved corner portion of said container wall, a radius of curvature of said curved corner portion being smaller than a radius of curvature of said wall portions being connected by said curved corner portion.

6. The paperboard packaging container according to claim 5, wherein said curved corner portion has a radius of curvature of 5-60 mm.

7. The paperboard packaging container according to claim 5, wherein said curved corner portion has a radius of curvature of 10-40 mm.

8. The paperboard packaging container according to claim 5, wherein said curved corner portion has a radius of curvature of 15-30 mm.

9. The paperboard packaging container according to claim 1, wherein each of said upper and lower end edge of said container wall includes two wall end edge portions and two corresponding wall portions having an outwardly curved shape, wherein said two wall end edge portions and said two corresponding wall portions are opposing wall end edge portions and wall portions.

10. The paperboard packaging container according to claim 1, wherein each of said upper and lower end edge of said container wall includes two wall end edge portions and two corresponding wall portions having an outwardly curved shape, wherein said two wall end edge portions and said two corresponding wall portions are outwardly bulging with the same radii of curvature.

11. The paperboard packaging container according to claim 1, wherein all container body wall portions have the same radii of curvature.

12. The paperboard packaging container according to claim 1, further comprising an inner peelable or openable sealing membrane forming a cross-sectional seal between an inner compartment in the container body and the container opening.

13. The paperboard packaging container according to claim 1, further comprising an openable and closable lid, such as a hinged lid, said lid being arranged to cover said container opening and being arranged to engage with said upper reinforcing rim to form a closure on said container.

14. The paperboard packaging container according to claim 1, wherein said container is a container for pulverulent or granulated food-stuff.

15. The paperboard packaging container according to claim 1, wherein said container is a container for tobacco.

16. The paperboard packaging container according to claim 1, wherein said edge portion of said container wall has a radius of curvature between 400-500 mm.

17. The paperboard packaging container according to claim 1, wherein each of said upper and lower end edge of said container wall includes two wall end edge portions and two corresponding wall portions having an outwardly curved shape and having a radius of curvature of 300-600 mm.

18. The paperboard packaging container according to claim 1, wherein each of said upper and lower end edge of said container wall includes two wall end edge portions and two corresponding wall portions having an outwardly curved shape and having a radius of curvature of 400-500 mm.

19. The paperboard packaging container according to claim 1, wherein said container wall has an outer surface intersecting and terminating at said terminal upper end edge.

* * * * *